United States Patent [19]

Leikin et al.

[11] Patent Number: 5,046,670

[45] Date of Patent: Sep. 10, 1991

[54] CRUSHING DEVICE

[76] Inventors: Vladimir Z. Leikin, prospekt Suslova, 21, korpus 6, kv. 89; Viktor P. Neradov, Beloostrov, Alexandrovskoe shosse, 41; Ivan M. Dianov, Zverinskaya ulitsa, 17a, kv. 9; Pavel M. Luzin, Institutsky prospekt, 9, kv. 68, all of Leningrad; Evgeny D. Gorbunov, ulitsa Shkolnaya, 5, kv. 12, Syzran; Vladimir D. Gerasimov, ulitsa Lensoveta, 75, kv. 40, Leningrad; Vladimir A. Baranchugov, ulitsa Bubnova, 15, kv. 39, Chelyabinskaya oblast, Kusa, all of U.S.S.R.

[21] Appl. No.: 448,159

[22] Filed: Dec. 8, 1989

[51] Int. Cl.[5] ..... B02C 13/00

[52] U.S. Cl. ..... 241/194; 241/275

[58] Field of Search ..... 241/275, 189 R, 189 A, 241/194, 195, 154

[56] References Cited

U.S. PATENT DOCUMENTS

| | | | |
|---|---|---|---|
| 1,758,010 | 5/1930 | Pettinos | 241/154 |
| 1,798,465 | 3/1931 | Grindle | 241/154 |
| 1,876,416 | 9/1932 | Hill | 241/154 |
| 2,700,511 | 1/1955 | Denovan et al. | 241/154 |
| 3,860,184 | 1/1975 | Acton | 241/275 |
| 4,373,679 | 2/1983 | Kawano et al. | 241/275 |

FOREIGN PATENT DOCUMENTS 121746 3/1986 U.S.S.R. .

*Primary Examiner*—Mark Rosenbaum
*Assistant Examiner*—Frances Chin
*Attorney, Agent, or Firm*—Lilling and Lilling

[57] ABSTRACT

A crushing device includes a casing with an inner wall, a rotor having a vertical axis of rotation, mounted in the casing and formed by a disk having a working surface with radially arranged fractionating blades mounted thereon and each including a working lateral face and a lateral face opposite to said working lateral face and each consisting of a main portion rigidly secured relative to the rotor disk and located nearer to the rotor axis and a peripheral portion pivoted to the rotor disk, rotatably mounted about the vertical axis, and having a section radially extending beyond said disk, and stationary grinding elements placed on the inner wall of the casing and arranged coaxially with the rotor disk. The stationary grinding elements appear as projections facing the rotor axis and are located above the sections of the peripheral parts of the blades extending beyond the disk, and spaced from the working surface of the rotor disk by a distance corresponding to the predetermined maximum size of the pieces of material in the final crushed product, said projections being arranged in a spaced relationship radially to the rotor disk. In addition, the device comprises a rotor drive.

10 Claims, 9 Drawing Sheets

CRUSHING DEVICE

BACKGROUND OF THE INVENTION

1. Field of the Invention

The present invention relates to devices for grinding raw materials and can be used in power engineering, in construction, mining, chemical and other industries. The invention can be most advantageously employed in crushing devices designed to prepare the solid organic fuel for burning and gasification in fluidized-bed thermal power plants.

2. Description of the Related Art

The effective operation of fluidized-bed plants implies the use of a fuel with a relatively narrow fraction composition.

To combat unburned carbon and carryover loss, it is particularly important that the fuel used in such plants contain the lowest possible amount of fine fractions (smaller than 1 mm).

So the crushing devices designed to prepare the fuel for burning and gasification, preferably in fluidized-bed thermal power plants, must provide as uniform crushed product as possible, with a minimum fine-fraction content.

Known in the art is a crushing device comprising a casing accommodating a rotor having a vertical axis of rotation and formed by a disk with fractionating blades and movable grinding elements. The latter are beaters rotatably mounted about the vertical axes and extending radially beyond the rotor disk. In addition, stationary grinding elements in the form of baffle plates are mounted on the casing of the device coaxially with the rotor (U.S. Pat. No. 3,860,184).

In this apparatus, the material is crushed in the following way. The raw material is fed, through an inlet duct, onto the central part of the rotating disk of the rotor, is acted upon by Coriolis force to thrust it against the working faces of the fractionating blades, is then transported therealong to the periphery of the rotor disk by centrifugal forces and flung outwardly to the reflecting surface of the stationary grinding elements. The material is ground as a result of striking against the stationary grinding elements. The material subjected to primary crushing is brought down along the walls of the crusher casing, strikes the beaters of the movable grinding elements, and is further ground by abrasive action within the space between these elements and the casing.

The final crushed product drops down and is discharged from the plant through an outlet duct. In this device, the maximum size of the pieces in the crushed product is generally controlled by the rotational speed of the rotor, i.e. by the impacting forces between the pieces of the material and the stationary grinding elements.

Metallic and other non-crushable bodies that have got into the crushing device are flung off, together with the material, under the action of centrifugal force, towards the inner wall of the casing. The non-crushable bodies, on striking the rotatable beaters, deflect them, fall down from the grinding zone, and are discharged along with the final crushed product. The deflected beaters are returned by centrifugal force to the initial position.

So in this crushing device, by virtue of making each beater rotatable about the vertical axis, the beaters are protected from damages as a result of impacting non-crushable objects, and in addition, these objects are removed from the grinding zone, thus ensuring a relatively high reliability both of the grinding elements and of the entire rotor of the crusher.

Since the grinding of the material, however, is here accomplished due to impacting and abrasive action and the crushing size is largely controlled by the rotational speed of the rotor, the final product will contain an increased amount both of coarser fractions (due to different strengths of the pieces) and of finer fractions (due to abrasion), which leads to a non-uniform crushed product with a relatively high fine-fraction (less than 1 mm) content of the product.

Besides, extra unproductive power expenses are required for overgrinding.

Furthermore, the non-crushable bodies that have found their way into the crushing device, mix with the final crushed product, when the rotatable beaters are deflected, resulting in a poorer quality of the product.

In addition, during operation of the crusher, the working surface of the rotor disk, the fractionating blades, and the movable and stationary grinding elements are worn out, leading to a shorter life of the crushing device and making it less reliable.

It will be noted, that the end faces of the beaters (i.e. the movable grinding elements) particularly suffer from wear. Consequently, in operation, the beaters often have to be replaced, so that their life is relatively short, resulting in extra metal expenses.

Known in the art is a crushing device comprising a casing accommodating a rotor having a vertical axis of rotation and formed by a disk with radial fractionating blades placed on the working surface thereof, including each a working lateral face and consisting of a main portion rigidly secured to the disk and located nearer to the rotor axis, and a peripheral portion attached to the rotor disk by a hinge and rotatable about the vertical axis, and stationary grinding elements mounted on the casing coaxially with the rotor disk and formed by projections facing the rotor axis. The projections are disposed above the disk, and more specifically, above the peripheral portions of the fractionating blades, and spaced from the working surface of the disk by a distance "H" corresponding to the predetermined maximum size of the pieces in the final crushed product. The device further includes a rotor drive (SU, A, 1,217,467).

The distance between the working surface of the rotor disk and the projections is dependent on a number of factors, such as the kind of material, the operating conditions of the crusher, etc. Therefore, it is determined experimentally, depending on the required maximum size of the pieces in the crushed product.

The crushing device operates as follows. The raw material is fed through the inlet duct onto the central part of the rotating disk of the rotor, is thrust by Coriolis force against the working faces of the radially extending fractionating blades, and is then transferred, under the action of centrifugal force, along the blades towards the periphery of the rotor disk. The working faces of the fractionating blades are those directed in the rotating sense of the rotor.

When the material has reached the periphery of the rotor disk underlying the projections, the pieces of a size exceeding the space between the working surface of the disk and the projections are subjected to grinding. The lower part of the pieces is then thrust against the blades, while the upper part thereof, on impacting the projections, is chipped off by the lower edges of the blades at a height determined by the specified maximum size of the pieces in the crushed product.

The lower, chipped-off, part of the pieces is flung off towards the inner wall of the device, drops along said wall, and is discharged from the device through the outlet duct, whereas the remaining upper part of the pieces, gradually sinking, is subjected to further grinding. The pieces of a size less than the required maximum size of the pieces in the final crushed product pass under the lower edges of the projections without being crushed, and are flung off towards the casing wall, dropping the realong to be also discharged through the outlet duct.

So in such crushing device, in contrast to the device disclosed in U.S. Pat. No. 3,860,184, the grinding of the material is largely performed through the mechanism of shearing, the maximum size of the pieces in the product being controlled by the height at which the material is sheared, which substantially reduces the amount of both the coarser and the finer fractions in the final crushed product, thus resulting in a more uniform end product.

In this case, since the material crushing is accomplished essentially by shearing, the rotational speed of the rotor is set at a much lower value (by a factor of two to three) than that required for impact crushing, in the device of U.S. Pat. No. 3,860,184, and so the pieces that have passed between the lower edges of the projections and the working surface of the disk without being crushed, practically, are not overground as a result of striking the casing wall. On the other hand, the larger lumps subjected to crushing by shear force are slowed down in the crushing zone and arrive at the wall of the crusher casing at a low speed which is insufficient for impact destruction, again leading to a relatively low amount of fine fractions in the final product.

The non-crushable objects, however, that happen to get into the crushing device and whose size exceeds the spacing between the working surface of the rotor disk and the projections, as they impact the rotary peripheral portions of the blades and cause them to be deflected, fail to pass under the projections and, staying on the rotor disk, they repeatedly strike both the projections and the fractionating blades, entailing the risk of their damage and consequently reducing operational reliability of the rotor and the entire device.

Moreover, in use, the non-crushable bodies are accumulated on the rotor disk, leading to abrasion of the material between these bodies with the consequent increase of the amount of fine fractions (i.e. less than 1 mm in size).

Further, since in this crusher, the stationary grinding elements in the form of projections are located above the peripheral portion of the disk plane, the material is liable to abrade between the lower surfaces of the stationary projections and the working surfaces of the rotary disk, again resulting in a greater amount of fine fractions in the end product. An increased amount of finer fractions in the end product, due to abrasion, is especially noticeable when crushing rather brittle materials.

In addition, to provide an effective crushing of the material, i.e. to ensure high local stresses as it is being crushed by shearing, sufficiently high crushing forces must be exerted. The higher crushing forces can be obtained by raising kinetic energy, and hence the mass of the movable grinding elements, for example, by increasing their thickness, while maintaining their length and width within structurally allowable limits.

In this crushing device, however, the maximum thickness of the rotary peripheral portions of the fractionating blades, which are located on the rotor disk and serve as movable grinding elements, is limited by the distance between the working surface of the disk and the projections, which is determined by the required maximum size of the pieces in the crushed product. In fact, the mass of the movable grinding elements may prove insufficient and they will tend to deflect during the crushing process, resulting in an additional abrasion of the material on the disk and in a relatively low efficiency of destroying the material by shearing.

Besides, the overgrinding of the material, similarly to the previous design, leads to excessive power consumption.

Furthermore, here, just as in the above mentioned design, an intense wear occurs, in operation, both of the rotor itself, i.e. the surface of the disk and the fractionating blades, and of the stationary grinding elements, shortening the life of the crusher and impairing its operational reliability.

Among the members most sensitive to wear are the grinding elements, i.e. the peripheral portions of the fractionating blades and the projections, these elements undergoing non-uniform wear in operation. Such non-uniform wear of the grinding elements results from the fact that the edges of said elements are primarily affected by the material being crushed, i.e. the lower lateral edges of the projections and the adjacent upper lateral edges of the peripheral blade portions. The wear of said edges of the grinding elements causes their geometry to be changed, bringing about an increased number of fractions larger in size than specified in the end product.

To avoid non-uniformity of the final crushed product and to extend the life of the grinding elements, in some crushers they are turned through 180°.

In the aforementioned device, it is possible to turn the projections through 180°, but only two opposite edges of the projections will be used in operation, which fails to prolong their operational life to a full extent.

The location of the peripheral blade portions, which are the movable grinding elements, on the rotor disk makes it difficult to turn them through 180°, since in this case, clearances will be formed between the worn edges of the peripheral blade portions and the working surface of the disk, and the material may get into these gaps, resulting in its undue abrasion and an additional abrasion of the peripheral portions of the blades. Therefore, in such device, like the previous design of U.S. Pat. No. 3,860,184, during operation of the crusher, the grinding elements, particularly the peripheral portions of the blades, have to be rather frequently replaced, which reduces their life and results in extra costs for metal.

SUMMARY OF THE INVENTION

It is an object of the present invention to provide a crushing device in which, to increase uniformity of the final crushed product with a low fine-fraction content, the grinding of the material is accomplished essentially by shearing.

Another object of the invention is to provide a crushing device in which, to increase uniformity of the final crushed product and to ensure a low fine-fraction content, the abrasive wear of the material is minimized.

Still another object of the invention is to provide a crushing device such that the grinding elements are protected from damage.

Yet another object of the invention is to provide a crushing device with an increased operational reliability.

A further object of the invention is to provide a crushing device with reduced power consumption for grinding the material.

Another object of the invention is to provide a crushing device with a longer rotor life.

Still another object of the invention is to provide a crushing device with an extended life of the grinding elements.

Finally, an object of the invention is to provide a crushing device wherein, to improve the quality of the final crushed product, the mixing of non-crushable bodies with the crushed product is minimized.

With these and other objects in view, there is provided a crushing device comprising a casing having an inner wall and accommodating a rotor having a vertical axis of rotation, mounted in said casing and formed by a disk with a working surface to support radially oriented fractionating blades including each a working lateral face and a lateral face opposite to said working lateral face, and consisting of a main portion rigidly attached to said rotor disk and positioned closer to the axis of said rotor, and a peripheral portion mounted on said rotor disk by means of a hinge, being rotatable about the vertical axis, and including a section extending radially beyond said disk. The device also comprises stationary grinding elements mounted on said inner wall of the casing coaxially with said rotor disk, formed by projections facing the rotor axis and located above said sections of the peripheral portions of the blades extending beyond said disk and spaced from said working surface of the rotor disk by a distance corresponding to the specified maximum size of the pieces in the final crushed product. Said projections are disposed with a radial clearance relative to said rotor disk. The device further comprises a rotor drive.

With the peripheral portions of the radially oriented fractionating blades extending radially beyond the rotor disk, the material, under the action of centrifugal force, goes beyond the disk and moves on along those sections of the peripheral portions of the fractionating blades extending beyond the disk, in a plane essentially coincident with the working surface of the rotor disk, neglecting the free fall of the particles.

An amount by which the piece is shifted down, in passing the whole length of the peripheral portion of the fractionating blades is determined by a ratio $$\frac{gt^2}{2},$$

where:

g, free fall acceleration, $m/s^2$, t, time during which the piece passes the peripheral portion of the blade, s.

So with the peripheral portion of the fractionating blade extending beyond the disk up to 0.2 m long, and with the material velocity of 30 mps, which is generally the case for centrifugal crushers, the piece, in passing the whole length of the blade, will only be shifted down by an amount equal to $$\frac{9.81}{2} \cdot \left(\frac{0.2}{30}\right)^2 = 0.000219 \text{ m} = 0.2 \text{ mm}.$$

When the material has reached the projections located above the peripheral portions of the fractionating blades and radially spaced from the rotor disk, those pieces are ground whose size exceeds the distance H between the working surface of the rotor disk and the projections. The lower part of the pieces is then thrust against the blades, while their upper part is sheared off by the lower edges of the projections. The lower, sheared-off, part of the pieces is removed from the crushing zone, and the remaining upper part of the piece, gradually sinking, is subjected to further shear crushing.

So in such crushing device, the grinding of the material, like the device according to SU, A, 1217467, is carried out essentially by shear.

Non-crushable bodies whose size exceeds the distance between the working surface of the rotor disk and the projections, as they move along the fractionating blades together with the material, cause, on striking the projections, the rotary peripheral portions of the fractionating blades to be deflected. When the rotary peripheral portions of the blades are deflected, the radial clearance between the projections and the rim of the disk is opened and the non-crushable bodies go down and, sinking under the lower edges of the projections, they drop between the inner wall of the casing and the rotor disk.

Thus, during operation of the device, the non-crushable bodies that have got into the crusher together with the material, are removed from the crushing zone, avoiding the risk of damage for the grinding elements as a result of impacting the non-crushable bodies, increasing thereby the reliability of the rotor with the fractionating blades mounted thereon, and consequently of the entire device.

In addition, the removal of non-crushable bodies from the crushing zone tends to minimize abrasion of the material by the non-crushable bodies on the rotor disk.

Furthermore, since the grinding of the material occurs outside the disk surface, i.e. when the material is in free space, its abrasion between the lower surfaces of the stationary projections and the working surface of the rotary disk is avoided, also reducing the amount of fine fractions in the final crushed product.

This reduction in fine-fraction content is particularly significant when crushing sufficiently brittle materials.

The reduced amount of fine fractions in the final product leads to a lower power consumption necessary for grinding the material.

Besides, the fact that the peripheral portions of the fractionating blades are made to extend beyond the rotor disk will enable these portions to be turned through 180°, when their working edges have suffered from abrasive wear during operation of the device. This results in a longer life of these portions.

It is preferable that recesses by provided behind each peripheral portion of the fractionating blade at the lateral face of the blade opposite to its working lateral face, these recesses serving to receive the peripheral portions of the fractionating blades as they are deflected from the radial direction.

For efficient crushing of the material, i.e. to provide high local stresses, when the material is destroyed by shearing, it is necessary that sufficiently high crushing forces be exerted. These forces can be obtained by increasing the kinetic energy and hence, the mass of the grinding elements, in particular for the peripheral portions of the fractionating blades, which are the movable grinding elements, by increasing their thickness with the structurally allowable length and width.

The thickness of the rotary peripheral portions of the blades in the direction from the working surface of the disk to the projections, however, is limited by the specified distance between the working surface of the disk and the projections, which is chosen according to the required maximum size of the pieces in the final crushed product.

On the other hand, when the thickness of the peripheral portions of the blades is made to increase in the other direction from the working surface of the disk, they are prevented from being turned from the radial direction so that the radial clearance between the projections and the rim of the disk could be fully opened for easy removal of non-crushable bodies from the cushing zone.

On the contrary, the recesses provided in the rotor disk permit the peripheral portions of the fractionating blades to be made of increased thickness in both directions from the rotor disk, embracing the disk on both sides, i.e. with an increased mass necessary for effective crushing of the material, while also enabling them to be turned from the radial direction so that the radial clearance between the projections and the disk rim is fully opened.

Radial box projections are preferably provided on said working surface of the rotor disk, which are rigidly secured relative to the disk, said box projections having each an upper, a first, and a second side walls, said first side wall of the box projection being said working lateral face of the fractionating blade, said second side wall of the box projection being located behind said recess in the rotor disk.

When charging the material and during operation of the crusher, as a result of random motion of individual pieces as they impact each other or strike against the grinding elements, the fractionating blades, etc., the uncrushed pieces may get into the recesses in the rotor disk and subsequently mix with the final crushed product, leading to the coarsening thereof.

The box projections provided on the surface of the rotor disk, which cover the recesses made in the disk at the top and on both sides prevent the uncrushed pieces from getting in, thus giving a more uniform mass of the crushed product.

Said box projections form the non-protruding parts of the fractionating blades (including the main portions of the blades and those sections of their peripheral portions lying on the rotor disk), and one of the side walls of these box projections is the working lateral face of the fractionating blade.

The non-protruding parts of the blades built in the form of box projections will contribute to an increased rigidity and strength of the blades and the entire rotor, thus making a more reliable device.

In the crushing device with a hole made in each peripheral portion of the fractionating blade, with holes made in said rotor disk in alignment with said holes made in the peripheral portions of the blades, and with fingers having heads at the top inserted into said holes, said hinges being formed by said fingers and said holes in the peripheral portions of the blades and in the rotor disk, it is advisable that openings be provided in the upper wall of each box projection opposite said heads of the fingers, to allow the insertion and withdrawal of said fingers.

The openings present in the upper walls of the box projections enable the fingers securing the peripheral portions of the blades to the rotor disk to be inserted and extracted through said projections, thus facilitating the reversal and replacement of the peripheral portions of the blades.

It is preferably that each said head of the finger be positioned asymmetrically to the axis of rotation of the finger, and each said opening in the upper wall of the box projection for insertion and withdrawal of said fingers be so arranged on said wall that the distance, in the radial direction from the rotor axis between the axis of said hinge and the edge of said opening, is less than the maximum distance from the axis of rotation of said finger to the rim of said finger head.

Such arrangement of the finger heads and the openings in the upper walls of the box projections, while providing a reliable positioning of the fingers, results in a still easier reversal and replacement of the peripheral portions of the blades subject to rapid wear.

The reliable positioning of the fingers in the axial direction is ensured by making their withdrawal only possible in alignment of the most extended sections of the heads with the openings made in the upper wall of the box projections, i.e. with the fingers in such a position which they cannot occupy in rotation, since under the action of centrifugal force, the finger heads are turned at a point most removed from axis of rotation of the fingers, as directed from the rotor axis. When the rotor is rotated, the finger heads, at the points most removed from the pivotal axis of the fingers, will be located on the upper wall of the box projection, behind the edge of the opening.

A lining plate is preferably mounted on the working surface of the rotor disk, the main portions of the fractionating blades being placed on said lining plate.

The lining plate with the main portions of the fractionating blades provided thereon, while protecting the rotor disk from wear, is a detachable member which is readily replaced in operation of the crusher, extending the life of the rotor and the entire device and increasing its reliability.

It is also advisable that the rotor be made symmetric about the horizontal plane. It is also preferred that each said projection of the stationary grinding elements be symmetric about the plane coincident with the rotor axis and that the drive be made reversible.

Such construction of the rotor, the projections of the stationary grinding elements, and the rotor drive enables the rotor of this crushing device to be turned through 180° and so, in conjunction with individual 180° reversals of the movable peripheral portions of the blades and of the projections, during operation of the device, to utilize all the four edges both of the stationary grinding elements (i.e. the projections) and of the movable grinding elements (i.e. the peripheral portions of the fractionating blades) and, in addition, to use the second surface of the disk with the main blade portions mounted thereon as the working surfaces, thus extending the life both of the grinding elements (i.e. the projections and the peripheral portions of the fractionating blades) and of the rotor disk with the portions of the blades mounted thereon, with the consequent metal saving.

It is also advisable that a screen grating be secured to the casing, coaxially with the rotor, be mounted below the working surface of the rotor disk and radially spaced therefrom, and be provided at the bottom with a shell and an outlet duct for discharging noncrushable bodies.

The crushed material flung off towards the inner wall of the crusher casing passes above the screen grating and is removed from the device through the outlet duct. The non-crushable bodies falling down from the crushing zone, when the peripheral portions of the blades are deflected, are trapped by the screen grating, enter the clearance between the rotor disk and the grating, and are then discharged from the device through the duct for removal of non-crushable objects; in other words, the non-crushable objects are separated from the final crushed product, providing a good quality end product.

When grinding feed materials containing a large amount of high-strength, viscous fractions, such as granite and hard limestone inclusions, it is possible to realize a crushing device which has mounted on each said protruding section of the peripheral portion of the fractionating blade, at the working lateral face end of the blade, a plate located in a horizontal plane and including an upper surface and a top edge facing said rotor disk, said upper surface of the plate being coincident with said working surface of the rotor disk, said edge of each plate facing the rotor disk following the arc of the circle that defines the rotor disk. The distance between the axis of said hinge serving to attach said peripheral portion of the blade to the rotor and the point of said plate farthest removed from the disk does not exceed the shortest distance from the axis of said hinge to said inner wall of the apparatus casing.

When crushing materials containing large amounts of high-strength viscous fractions, in the crushing device of the basic embodiment, the viscous pieces of the feed material that have not been crushed after several collisions with the projections may get into the radial clearance between the projections and the disk rim, which would result in an increased amount of coarse fractions.

With said plates whose upper surface is an extension of the working surface of the disk, the shear crushing of the material takes place on the surface of these plates bridging the radial clearance between the projections and the disk, preventing the hard-to-grind pieces of increased hardness and viscosity from dropping into the clearance. They are ground to specified size between the upper surface of the plate and the lower edges of the projections, ensuring a greater uniformity of the end product when crushing the materials with a large amount of strong, viscous fractions.

In this case, the overgrinding of the material due to abrasion between the stationary projections and the working surface of the rotating plates is insignificant because of an increased strength of the material.

If non-crushable bodies get onto the rotor disk, the peripheral portions of the blades with the horizontal plates mounted thereon are deflected, similarly to the basic embodiment of the invention, and enter the recesses cut in the disk. This is made possible by virtue of the fact, that the distance between the axis of rotation of the hinge of each peripheral portion of the fractionating blade and that point on said plate most removed therefrom does not exceed the shortest distance between the axis of said hinge and the inner wall of the casing.

With such construction of the crushing device, the centre of gravity of said peripheral portion of the blade is preferably displaced, relative to the line passing through the axis of said hinge and the axis of rotation of said rotor disk, towards the lateral face of the blade opposite to its working lateral face.

The displacement of the centre of gravity of each peripheral portion of the blade with respect to the line passing through the axis of rotation of this portion and the axis of rotation of the disk results in a tight fit of the plate against the outer surface of the disk under the action of centrifugal moment.

BRIEF DESCRIPTION OF THE DRAWINGS

These and other objects and advantages of the present invention will be more apparaent from the detailed description of its preferred embodiments taken in conjunction with the accompanying drawings, wherein.

DESCRIPTION OF THE PREFERRED EMBODIMENT

Figure 1:
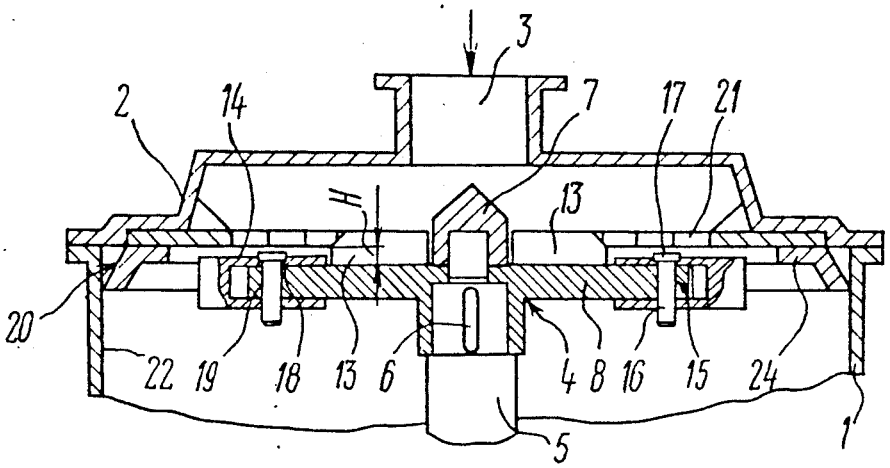
FIG. 1 is a sectional view taken longitudinally and showing a crushing device, according to the invention.

The crushing device, according to the invention, comprises a cylindrical casing 1 (FIG. 1) with a cover 2 fitted thereon and provided with an inlet duct 3 for feeding the source material. Placed inside the casing 1 is a rotor 4 mouted on a vertical shaft 5 by means of a key 6 and a conical cover 7 and provided with the rotor drive (not shown).

Figure 2:
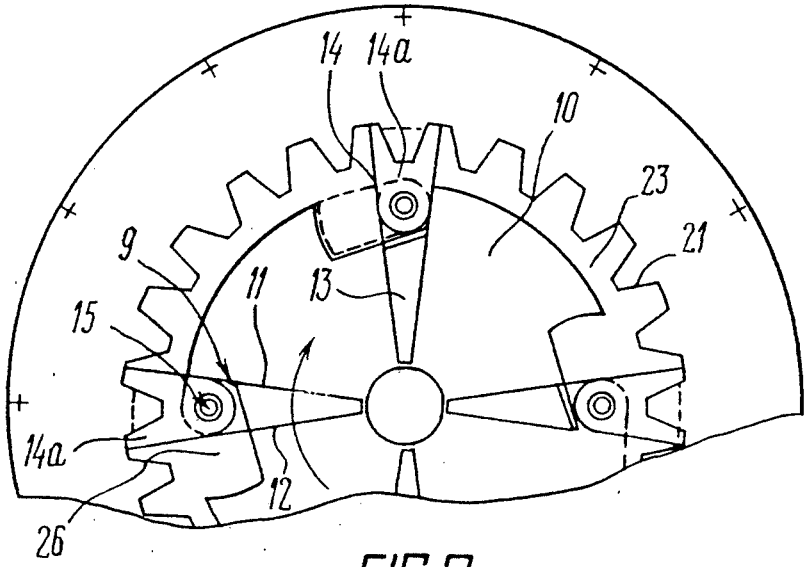
FIG. 2 is a top view of part of the crushing device as shown in FIG. 1, with the cover and outlet duct removed.

The rotor 4 is formed by a disk 8 having radially oriented fractionating blades 9 mounted thereon (FIG. 2).

The surface of the disk 8 facing the inlet duct 3 serves as a working surface 10 of the disk 8.

The lateral faces of the fractionating blades 9 facing the rotating sense of the rotor 4 are working lateral faces 11, whereas faces 12 opposite thereto are non-working.

Each fractionating blade 9 consists of a main portion 13 rigidly secured relative to the disk 8 of the rotor 4 and located closer to the axis of the rotor 4, and a peripheral portion 14 including a section 14*a* radially extending beyond the disk 8 of the rotor 4. The peripheral portions 14 of the blades 9 are attached to the disk 8 of the rotor 4 by means of hinges 15 (FIG. 1). The hinges 15 are each formed by a finger 16 with a head 17 at the top of it, placed within coaxial holes 18, 19 of which one hole 18 is made in the peripheral portion 14 of the blade 9 and the other hole 19, in the disk 8 of the rotor 4.

The configuration of the peripheral portions 14 of the blades 9, which serve as movable grinding elements of the device, is determined by structural considerations and based on a familiar assumption of increasing the mass of said portions 14, and consequently their kinetic energy required for achieving sufficiently high crushing forces necessary for effective destruction of the material by shearing.

In this crushing device, the peripheral portions 14 of the blades 9 are made of increased thickness symmetrically about the disk 8 and embracing the disk on both sides.

Also possible is another embodiment of the peripheral portions 14 of the blades 9 similar to that employed in the device according to SU, A, 1217467, in which the peripheral portions 14 of the blades do not embrace the disk 8, i.e. their lower face adjoins to the working surface 10 of the disk 8.

In order that the rotary peripheral portions 14 of the fractionating blades 9, during operation of the devece, take a position coinciding with the radial direction, each peripheral portion 14 (FIG. 2) of the blade 9 may be made with the axis of the hinge 15 shifted from the center of gravity of said portion 14 towards the axis of the rotor 4.

An embodiment of the peripheral portions of the blades with no displacement of their axes of rotation is an alternative. In this case, however, it is necessary to provide additional means to maintain the peripheral portions 14 of the blades 9 in a position coincident with the radial direction.

Located above the sections 14*a* of the peripheral portions 14 of the blades 9 extending beyond the disk 8 of the rotor 4, coaxially with the disk and spaced by as small a clearance as it is structurally justified, are stationary grinding elements 20 represented by projections 21 facing the axis of the rotor 4 and secured to an inner wall 22 of the casing 1.

The distance H from the working surface 10 of the disk 8 of the rotor 4 to the projections 21 is determined by the specified maximum size of the pieces in the final crushed product. This distance H is dependent on a number of factors such as the kind of material and the operating conditions of the device, and therefore it is found experimentally using established methods.

The projections 21 are radially spaced from the edge of the disk 8 of the rotor 4 by a clearance 23 (FIG. 2). The width of the clearance 23 is determined by the operational performance of the crusher including the maximum possible size of non-crushable objects.

The projections 21 are placed within adjacent holders 24 and secured to the inner wall 22 of the casing 1. The stationary grinding elements 20 may be shaped as a ring 25 (FIG. 4) attached to the inner wall 22 of the casing 1 with the projections 21 mounted thereon and facing the axis of the rotor 4.

On the disk 8 of the rotor 4, immediately behind each peripheral portion 14 of the blade 9, at the lateral face 12 of the blade 9 opposite to its working lateral face 11, there are provided recesses 26 (FIG. 2) to receive the peripheral portions 14 of the fractionating blades 9, when they are deflected from the radial direction during operation of the device. The disk 8 of the rotor 4 may be fabricated without any recesses 26. Provided at the bottom of the casing 1 of the device is an outlet duct 27 (FIG. 6) for discharging the final crushed product.

Figure 3:
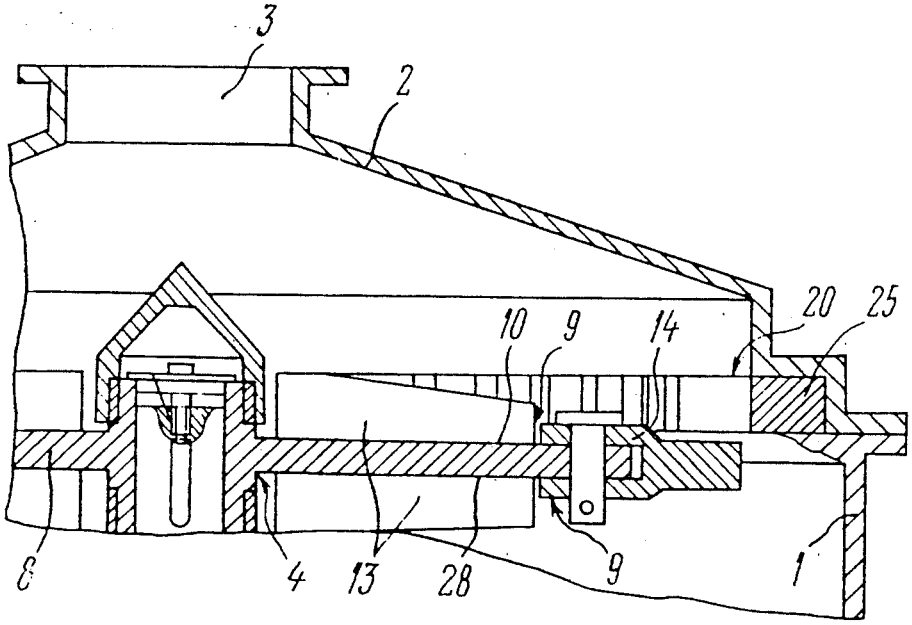
FIG. 3 is an enlarged sectional view taken longitudinally and showing a crushing device in accordance with an embodiment including a rotor symmetrically mounted about the horizontal plane.

The rotor 4 (FIG. 3) is made symmetric about the horizontal plane, i.e. fractionating blades 9 are mounted on the surface 28 of the disk 8 of the rotor 4 opposite to its working surface 10, said fractionating blades 9 being similar to, and in symmetry with, the blades 9 provided on the working surface 10 of the disk 8. Each projection 21 (FIG. 4) of the stationary grinding elements 20 is made symmetric about the plane coincident with the axis of the rotor 4.

The drive (not shown) of the rotor 4 is made reversible.

With such construction of the crushing device, the lateral edges 29 to 32 (FIGS. 4,5) of the peripheral portions 14 of the blades 9 and the lateral edges 33 to 36 of the projections 21 may all be working edges, i.e. they all may participate in crushing the material.

In another embodiment as, for example, with no recesses 26 in the disk 8 of the rotor 4, the rotor 4 may be made asymmetric about the horizontal plane. In this case, the life of the peripheral portions 14 of the blades 9 is comparable to that in the aforementioned embodiment. The device may also incorporate an asymmetric rotor 4 (FIG. 1) and a nonreversible drive (not shown). In this embodiment, the tips of the projections 21 may be displaced from the radial plane in the direction opposite to the rotating sense of the rotor 4.

Here the contacting surface between the material and the projections 21 is at a minimum, ensuring the most efficient destruction of the material by shearing.

This embodiment of the rotor 4, of the drive (not shown) and of the projections 21, however, fails to provide a longer service life either of the grinding elements (i.e. the projections 21 of the peripheral portions 14 of the blades 9) or of the rotor 4.

Mounted coaxially with the rotor 4, on the inner wall 22 of the crusher casing 1 is a screen grating 37 (FIG. 6) located below the working surface 10 of the disk 8 of the rotor 4 and radially spaced from the rotor. A shell 38 with a duct 39 for discharging non-crushable bodies is attached to the bottom of the screen grating 37.

The mesh sizes of the screen grating 37 are chosen experimentally, using established methods, depending on the specified maximum size of the pieces in the final crushed product.

The radial clearance between the screen grating and the rotor disk is governed by operating conditions of the crusher, in particular, by the maximum possible size of non-crushable bodies.

In another embodiment, the crusher may be designed without any screen grating 37 (FIG. 1).

Figure 8:
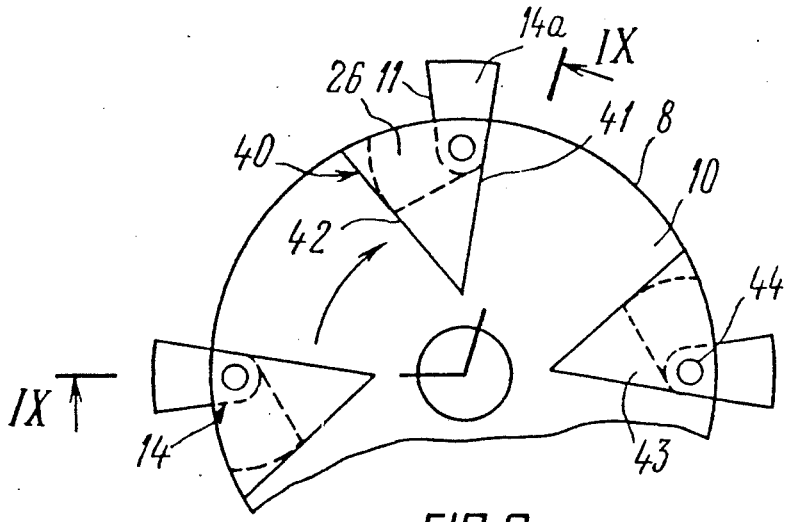
FIG. 8 is a top view of an embodiment of the rotor with box projections on the working surface of the rotor disk.
Figure 9:
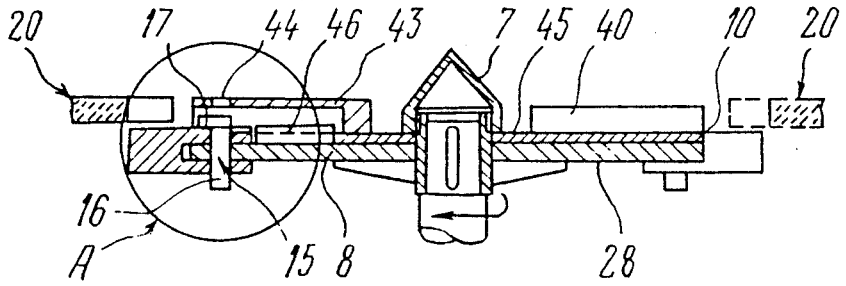
FIG. 9 is a sectional view taken along the line IX—IX of FIG. 8.

An embodiment of the crusher is possible in which radially extending box projections 40 (FIGS. 8,9) rigidly secured relative to the disk 8 are mounted on the working surface 10 of the rotor disk 8. A side wall 41 of each box projection 40 facing towards the rotating sense of the rotor 4 is the working lateral face 11 of the blade 9 and it is located before the recess 26 in the disk 8 of the rotor 4.

An opposite side wall 42 of the box projection 40 is located behind the recess 26.

These box projections 40 cover the recesses 26 provided in the disk 8 of the rotor 4 on the top and on both sides. They also cover those sections of the peripheral portion 14 of the blades that are located on the disk 8, as well as their hinges 15, to form parts of the blades 9 keeping within the disk 8 of the rotor 4, i.e. they include both the main portions 13 of the blades and those sections of the peripheral portions 14 of the blades 9 that are located on the disk 8 of the rotor 4.

Disposed on an upper wall 43 of each box projection 40, opposite to the head 17 of the finger 16 of the hinge 15 is an opening 44 for insertion and withdrawal of said finger 16. Since the box projections 40 overlap the hinges 15 that secure the peripheral portions 14 of the blades 9 to the disk 8, the provision of said openings 44 to help insert and extract the fingers 16 eases the problem of turning and replacement of the peripheral portions 14 of the fractionating blades 9 subject to rapid wear.

Figure 10:
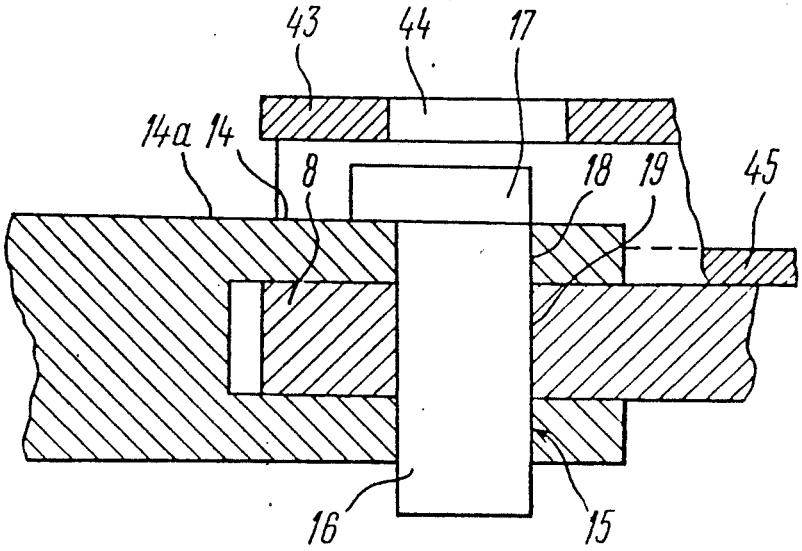
FIG. 10 is an enlarged view of the unit 1 of FIG. 9.
Figure 11:
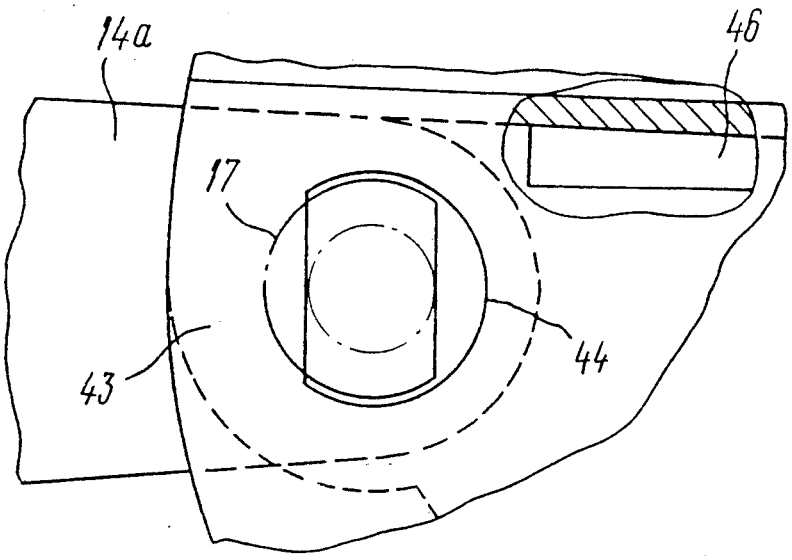
FIG. 11 is an enlarged top view of the unit 1 of FIG. 9.

Each head 17 (FIG. 10) of the finger 16 is made asymmetric about the axis of rotation of the finger 16, each opening 44 in the upper wall 43 of the box projection 40 being positioned on said wall 43 such that the radial distance along the disk 8 of the rotor 4, as viewed from the rotor axis, between the axis of said hinge 15 and the edge of the opening 44 is shorter than the maximum distance from the axis of rotation of the finger 16 to the edge of the head 17 of the finger 16. As an example, each head 17 of the finger 16 and each opening 44 may be shaped as identical segments of a circle cut by a chord, the cutoff portion of the circle of the opening 44 facing the periphery of the rotor disk 8. Alternatively, the head 17 of the finger 16 and the opening 44 may be formed by an ellipse, the longitudinal axis of symmetry of the elliptical opening 44 being at an angle to the radius of the disk 8 of the rotor 4.

Such arrangement results in a still easier procedure of insertion and withdrawal of the fingers 16 when turning over or changing the peripheral portions 14 of the blades 9, and leads to a reliable axial positioning of the fingers 16.

The reliable axial positioning of the fingers 16 is made possible by the fact, that they can only be extracted when the shapes of the heads 17 and the openings 44 are aligned, i.e. with the fingers 16 in a position which they cannot occupy when the rotor 4 is rotated, since under the action of centrifugal force, the eccentric heads 17 are turned in an opposite direction, i.e. away from the axis of the rotor 4.

In case the rotor 4 is made symmetric about the horizontal plane, in this embodiment, the box projections 40 will also be mounted on the surface 28 of the disk 8.

The rotor 4 may also be made without any box projections 40 on its disk 8 (FIG. 2).

On the working surface 10 of the disk 8 of the rotor 4, there is provided a detachable lining plate 45 (FIG. 9), the box projections 40 being formed on said plate 45. If no box projections are provided on the working surface 10 of the disk 8, the stationary main portions 13 (FIG. 2) of the fractionating blades 9 will be fitted on the lining plate 45.

The lining plate 45 is attached to the rotor 4 by means of the conical cover 7.

The plate 45 is locked in place against rotation by radial stops 46 (FIG. 9) rigidly secured to the disk 8.

The lining plate 45 which protects the disk 8 of the rotor 4 from wear is a detachable member capable of being readily replaced in service, thus extending the life of the rotor and the complete device and making it more reliable in operation.

Figure 12:
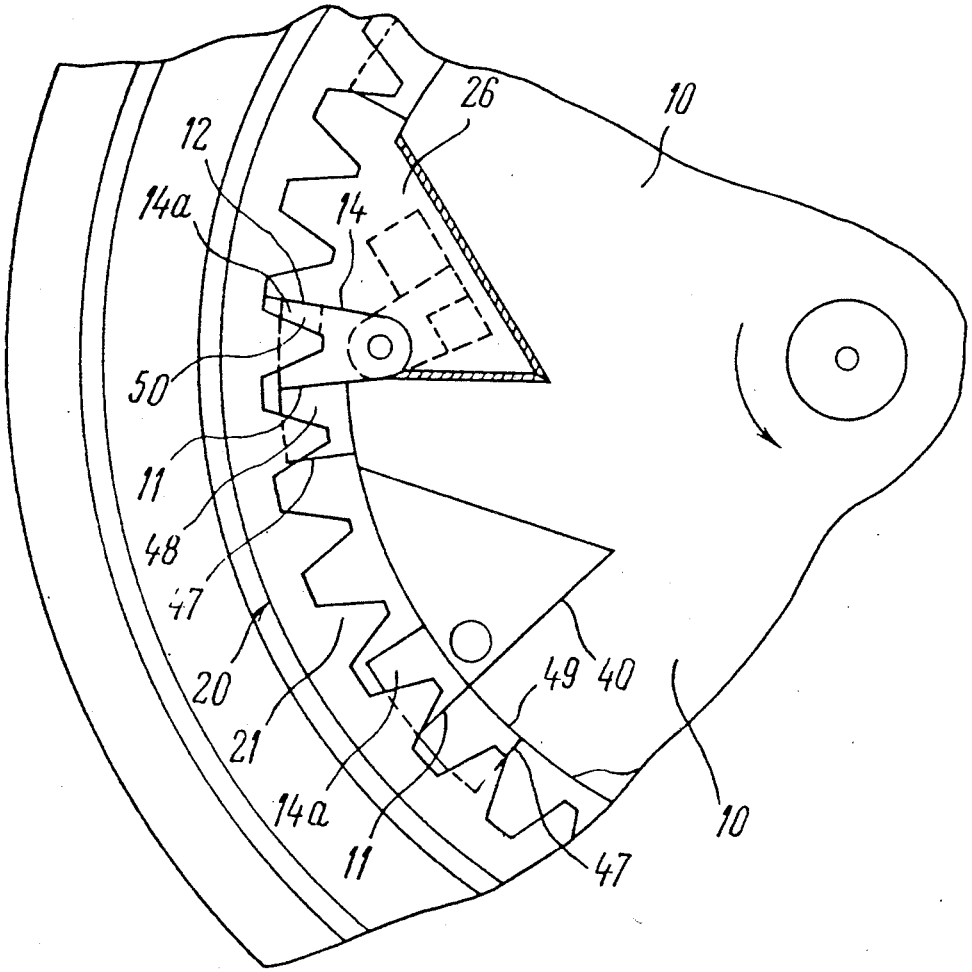
FIG. 12 is a top view of part of a crushing device with cover and inlet duct removed, as in the embodiment icluding horizontal plates mounted on the sections of the peripheral portion of the fractionating blades extending beyond the rotor disk.
Figure 13:
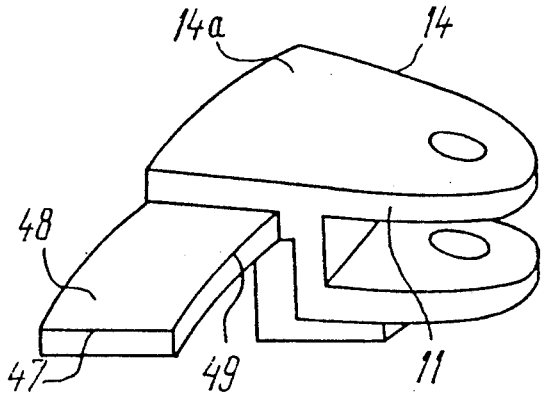
FIG. 13 is a perspective view of the peripheral portion of the blade, as in the crusher embodiment of FIG. 12.
Figure 14:
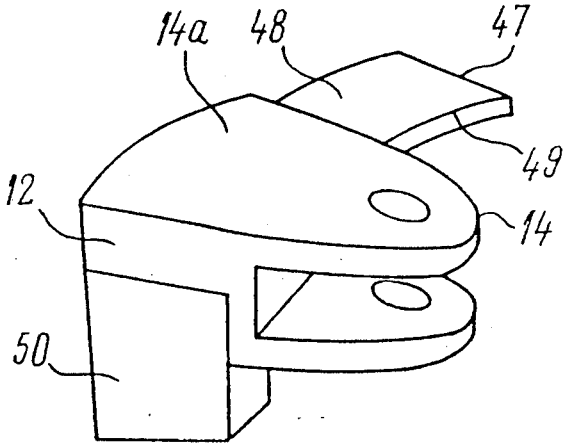
FIG. 14 is the same as FIG. 13, but as viewed from the balance weight end.

When crushing the material rich in high-strength viscous fractions, an alternative embodiment of the crusher is shown in FIGS. 12,13,14 in which on each section 14*a* of the peripheral portion 14 of the blade 9, there is provided, at the working lateral face 11 of the blade 9, a horizontal plate 47 (FIG. 12), an upper surface 48 of said plate 47 coinciding with the working surface 10 of the disk 8 of the rotor 4 and being itself a working surface. An edge 49 (FIGS. 13,14) of the plate 47, facing the disk 8, follows along the arc of its periphery so that the plate 47 adjoins to the disk 8 without any gap.

The distance (FIG. 12) between the axis of each hinge 15 which serves to attach the peripheral portion of the blades 9 to the disk 8 of the rotor 4 and that point on the plate 47 farthest removed therefrom does not exceed the shortest distance from the axis of said hinge 15 to the inner wall 22 of the casing 1. This is a necessary condition for the peripheral portions 14 of the blades 9 with the horizontal plates 47 mounted thereon to be turned from the radial direction. The center of gravity of each peripheral portion 14 with the plate 47 is horizontally displaced from the line passing through the axis of the hinge 15 of this peripheral portion 14 and the axis of rotation of the disk 8 of the rotor 4 towards the lateral face 12 of the blade 9 opposite to its working face 11.

For such displacement, the peripheral portion 14 of the blade 9 is provided with a balance weight 50 (FIGS. 13,14) located beneath the section 14*a* of said peripheral portion 14 of the blade 9 at the opposite end from the location of the horizontal plate 47. Alternatively, the peripheral portions 14 of the fractionating blades 9 may be designed with no displacement of the center of gravity. In this case, however, some other means are required to make the plate 47 closely adjoin to the rim of the rotor disk 8.

The crushing device, according to the invention, operates as follows.

The raw material is fed through the inlet duct 3 (FIG. 1) provided in the cover 2 of the casing 1 onto the central portion of the rotor disk 8 rotating about its vertical axis, is thrust by Coriolic force against the working lateral faces 11 (FIG. 2) of the fractionating blades 9, transported therealong by centrifugal force towards the periphery of the rotor disk 8 and then moves on beyond the disk 8 of the rotor 4 along the protruding sections 14*a* of the peripheral portions 14 of the fractionating blades 9.

The plane in which the material particles move outside the disk 8 of the rotor 4 (after the material has been transferred to those sections 14*a* of the peripheral portions 14 of the blades 9 extending beyond the disk 8) essentially coincides with the working surface 10 of the rotor disk 8, the free fall of the particles being negligible. So with the peripheral portion 14 of the blade 9 up to 0.2 m and with the velocity of the material of 30 mps (which is generally the case for the crushers), in passing the entire length of the peripheral portion 14 of the blade 9, the piece of material will be shifted down by an amount of 0.2 mm at most.

When the material has reached the projections 21 located above the sections 14*a* of the peripheral portions 14 of the blades 9 extending radially beyond the disk 8, those pieces are crushed whose size exceeds the distance H from the working surface 10 of the disk 8 of the rotor 4 to the projections 21. The lower part of the pieces is then thrust against the blades 9, while the upper part thereof is sheared off by the lower edges 33 of the projections 21.

Figure 6:
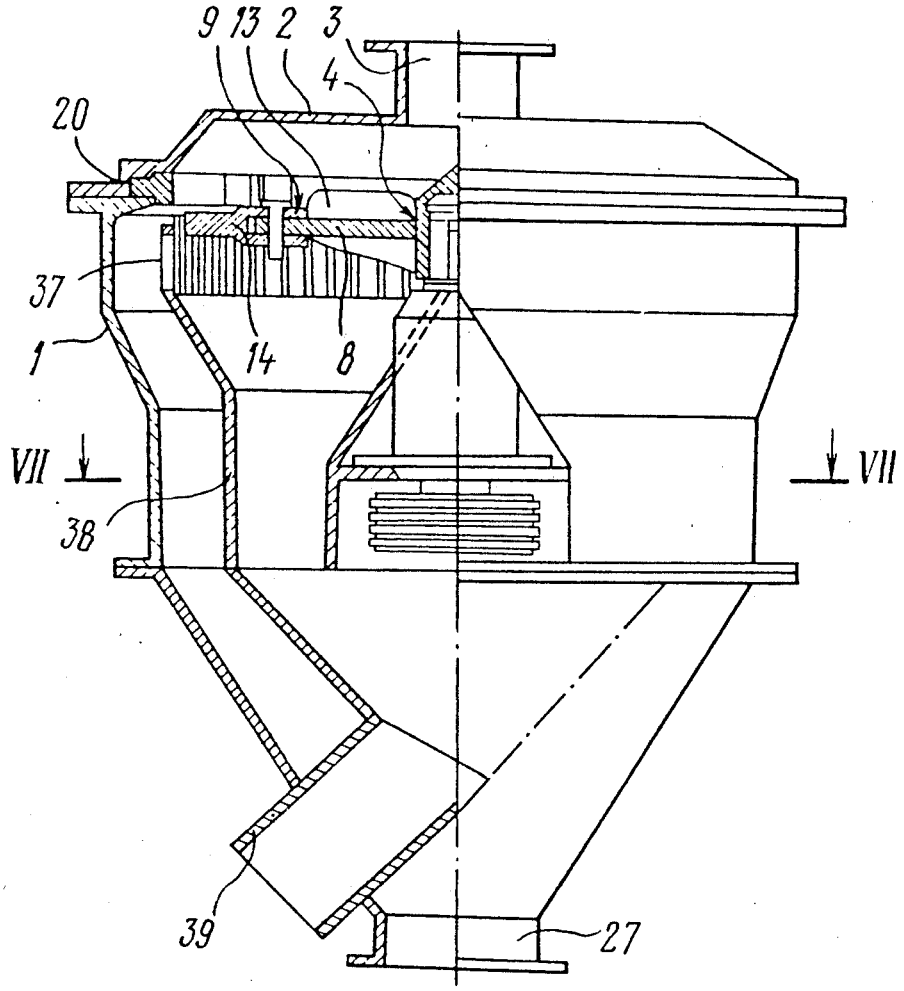
FIG. 6 is a sectional view taken longitudinally and showing another embodiment of the crushing device with a screen grating.
Figure 7:
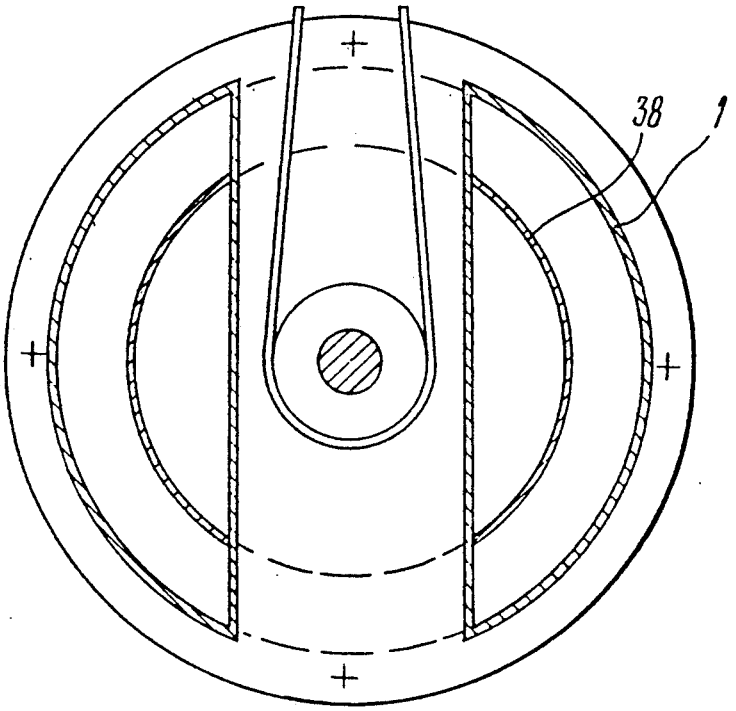
FIG. 7 is a sectional view taken along the line VII—VII of FIG. 6.

The lower, chipped-off, part of the pieces is flung towards the inner wall 22 of the casing 1, slides down therealong, and is discharged through the outlet duct 27, while the remaining upper part of the pieces, gradually sinking, is subjected to further crushing. The pieces whose size is smaller than the required maximum size of the pieces in the end product pass under the projections 21 without being crushed and are flung off towards the wall 22 of the casing 1, slide down therealong, and are also discharged from the apparatus through the outlet duct 27 (FIG. 6).

So in this crushing device, the material is ground largely by shearing, the maximum size of the pieces in the crushed product being controlled by the height H at which the material is sheared off, thus considerably reducing the number both of coarser and of finer fractions in the final product and consequently giving a more uniform crushed product.

Owing to the fact that in this crusher the grinding of the material is essentially effected by shearing, the rotational speed of the rotor 4 is chose to range from one-half to one-third of that required for impact crushing, and so the pieces that have passed under the projections 21 and the working surface 10 of the disk 8 without being crushed, practically, are not overground as a result of impacting the inner wall 22 of the casing 1, whereas the large lumps crushed by shearing are slowed down in the crushing zone and reach the inner wall 22 of the casing 1 at a low speed which is also insufficient for impact destruction.

The non-crushable bodies that have got into the crushing device together with the feed material and whose size exceeds the distance H between the working surface 10 of the disk 8 of the rotor 4 and the projections 21 will move with the material along the fractionating blades 9 and, striking the projections 21, will deflect the rotary peripheral portions 14 of the blades 9 into the recesses 26 in the disk 8, fully opening the radial clearance 23 between the projections 21 and the rim of the disk 8 of the rotor 4. The non-crushable objects then sink gradually into this clearance 23, and after they have sunk under the lower edges 33 of the projections 21, they drop down, and the previously deflected peripheral portions 14 of the blades 9 are returned, under the action of centrifugal force, to their initial position coinciding with the radial direction.

Because the peripheral portions 14 of the blades 9 secured to the disk 8 of the rotor 4 rotatably about the vertical axis are made radially extending beyond the disk 8, and the projections 21 are radially spaced from the disk 8 by the clearance 23, as the material is crushed essentially by shearing, the non-crushable bodies are caused to be removed from the crushing zone, thereby protecting from damage both the peripheral portions 14 of the blades 9 and the projections 21 and those portions of the blades 9 located on the disk 8 of the rotor 4, so that the reliability of the rotor 4 and the entire device is increased.

Besides, abrasion of the material by non-crushable bodies on the disk 8 of the rotor 4 is minimized.

In addition, since the grinding of the material takes place outside the plane of the disk 8, when it is in free space, abrasive wear of the material between the lower surfaces of the fixed projections 21 and the working surface 10 of the rotating disk 8 of the rotor 4 is avoided. Reduced abrasion of the material results in smaller amounts of fine fractions (less than 1 mm in size) in the final crushed product, and consequently in lower power consumption necessary for grinding the material.

This reduction in the amount of finer fractions is particularly significant when crushing rather brittle materials.

The recesses 26 provided in the disk 8 of the rotor 4 permits an increased mass of the peripheral portions 14 of the blades 9 (i.e. they are thickened symmetrically about the disk 8 of the rotor 4 and embrace the disk on both sides) necessary for effectively crushing the material by shearing, while allowing their turning from the radial direction such that the radial clearance 23 between the projections 21 and the disk 8 is fully opened.

When material is charged into the crusher and strikes the blades 9 and the projections 21, individual pieces randomly move about the working surface 10 of the disk 8.

Because of the box projections 40 provided on the working surface 10 of the disk 8 (FIGS. 8,9) which constitute the portions of the blades 9 located on the disk 8 of the rotor 4 (including the stationary main portions 13 of the blades 9 and the sections of the peripheral portions 14 keeping within the disk 8), the recesses 26 in the disk will be covered on both sides and on the top by the box projections 40, and the pieces randomly moving about the working surface 10 of the disk 8 of the rotor 4 will fail to penetrate said recesses 26 and and to drop into the end product without further crushing.

Since the working face 11 of each protruding section 14*a* of the peripheral portion 14 of the blade 9 is an extension of the working side wall 41 of the box projection 40, the material, as it moves along the fractionating blades, is transferred, without impact, from the working side wall 41 of the box projection 40 to said working lateral face 11 of the section 14*a* of the peripheral portion 14 of the blade 9.

Futhermore, such configuration of the portions of the blades 9 lying within the plane of the disk 8, which are shaped as box projections 40, tends to increase rigidity and strength of the blades 9 and the rotor 4, i.e. to improve reliability of the device.

The ground material and the material with lump sizes less than the distance H from the working surface 10 of the disk 8 of the rotor 4 to the projections 21 is flung by the working faces of the peripheral portions 14 towards the casing 1 of the device, passes over the screen grating 37 (FIG. 6), gets into the annular gap between the casing 1 and the screen grating 37, slides down along the inner wall 22 of the casing 1, and is discharged through the outlet duct 27.

The non-crushable bodies that have dropped from the crushing zone after deflection of the peripheral portions 14 of the blades 9 are trapped by the screen grating 37, slide down along the shell 38 and are discharged from the device through the duct 39.

The pieces of stock that have dropped past the deflected peripheral portions 14 of the blades 9 together with the non-crushable bodies are flung onto the screen grating 37 under the action of the radial component of their velocity.

The pieces whose size is smaller than that of the meshes of the screen grating 37 (and hence, less than the required maximum size of the pieces in the final crushed product) pass through these meshes and are discharged from the device together with the final crushed product through the outlet duct 27. The pieces with their size exceeding that of the meshes of the screen grating 37 are trapped thereby and are discharged together with the non-crushable bodies through the duct 39.

The screen grating 37 thus enables the non-crushable bodies to be separated from the final crushed product, improving the quality thereof.

In use, both the rotor 4 including the working surface 10 of the disk and the fractionating blades 9 with their peripheral portions 14 (the latter being the movable grinding elements) and the projections 21 of the stationary grinding elements 20 are subjected to wear.

It is the grinding elements, i.e. the peripheral portions 14 of the blades 9 and the projections 21 that are most susceptible to wear. Now, non-uniform wear of these elements occurs in operation, the lower lateral edges such as the edges 33 (FIG. 4) of the projections 21 and the adjacent upper lateral edges 29 of the peripheral portions 14 of the blades 9 being most affected by the feed material.

The wear of said edges 33,29 of the grinding elements brings about a change in their geometry and consequently, and increased amount of fractions exceeding the specified maximum size.

Figure 4:
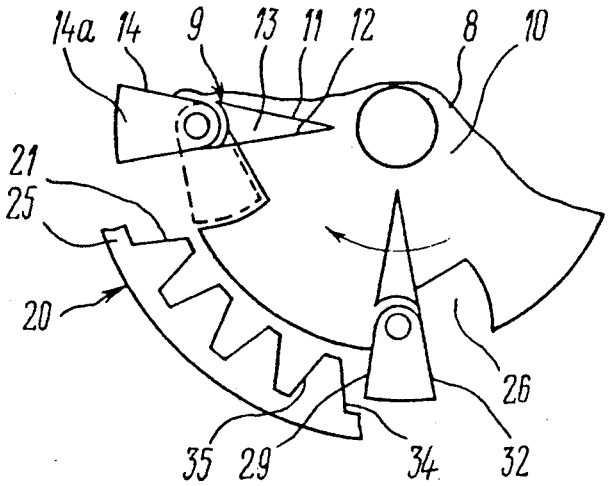
FIG. 4 is a top view of the rotor with stationary grinding elements as in the embodiment with a rotor symmetric about the horizontal plane.
Figure 5:
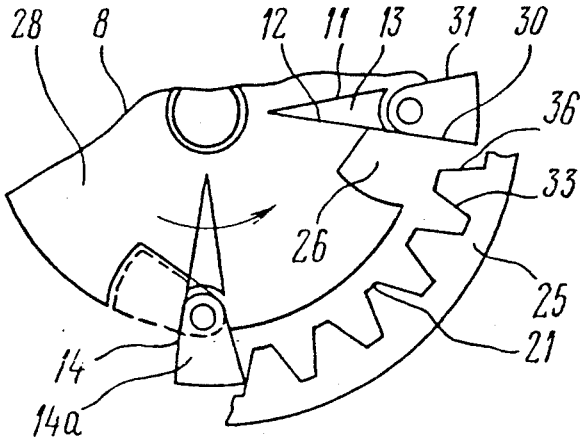
FIG. 5 is the same as FIG. 4, except that the rotor and projections are turned over and the rotating sense reversed.

To avoid coarsening the final crushed material during operation, as a result of abrasion of the lateral edges 33 of the projections 21 and the lateral edges 29 of the peripheral portions 14 of the blades 9, the projections 21 and the peripheral portions 14 of the blades 9 are turned through 180°, and it is now the edges 34 of the projections 21 and the edges 30 of the peripheral portions 14 of the blades 9 that appear as the working edges. (FIGS. 4,5).

By virture of the peripheral portions 14 of the blades 9 radially extending beyond the disk 8 of the rotor 4, they can be turned ever through 180°.

After abrasion of these edges 34,30, the rotor 4 is turned through 180° and the drive (not shown) reversed. Now the edges 31 of the peripheral portions 14 of the blades 9 and, correspondingly, the edges 35 of the projections 21 will become the working edges. Subsequently, the peripheral portions 14 of the blades 9 and the projections 21 may be turned through 180° once again.

So all the four edges 33 to 36 of the projections 21 and the edges 29 to 32 of the peripheral portions 14 of the blades 9 will sequentially participate in grinding the material.

The other surface 28 of the disk 8 of the rotor 4 and the portions of the fractionating blades 9 formed thereon will also become working members.

Owing to the fact that the rotor 4 (FIG. 3) is made symmetric about the horizontal plane, i.e. the blades 9 are provided on both the surfaces 10, 28 of the disk 8 of the rotor 4, that the projections 21 are made symmetric about the plane passing through the axis of the rotor 4 (FIG. 8), and that the drive (not shown in the drawing) is made reversible, the crusher rotor 4 is allowed to be turned through 180°, doubling the life both of the grinding elements (i.e. the projections 21 and the peripheral portions 14 of the blades 9) and of the rotor disk 8 with the portions of the blades 9 located thereon, and saving metal consumed.

For reversal or replacement of the peripheral portions 14 of the blades 9, the shapes of the heads 17 of the fingers 16 of the hinges 15 that serve to secure said portions 14 to the disk 8 of the rotor 4 are turned to come in alignment with the openings 44 made in the upper walls 43 of the box projections 40, and the fingers 16 are extracted through said openings 44.

When grinding the material containing a large amount of high-strength viscous fractions, an embodiment is preferably used comprising the horizontal plates 47 (FIG. 12) secured to the working lateral faces 11 of the blades 9, within the sections **14*a* of the peripheral portions 14 extending beyond the rotor disk 8, the plates bridging over the radial clearance 23 between the rotor disk 8 and the projections 21. In this case the material moving along the working lateral faces 11 of the fractionating blades 9 is transferred from the working surface 10 of the disk to the upper surface 48 of the plates 47**.

The displacement of the center of gravity of each peripheral portion 14 with the horizontal plate 47, relative to the line passing through the axis of the hinge 15 and the axis of rotation of the disk 8, towards the lateral face 12 of the peripheral portion 14 of the blade 9 opposite to its working lateral face 11, due to centrifugal force, ensures an intimate contact between the plate 47 and the rim of the disk 8 of the rotor 4. On reaching the projections 21, the material on said plate 47 is ground, the grinding being accomplished by shear mechanism, similarly to the aforementioned crusher made according to the basic embodiment of the invention.

However, since the material is destroyed on the surface 48 of the plate 47 bridging over the radial clearance 23 between the disk 8 and the projections 21, the hard-to-grind lumps of increased hardness or viscosity are prevented from falling through said clearence 23. They are reduced to the specified size between the upper surface 48 of the plates 47 and the lower edges such as the edge 33 of the projections 21.

The horizontal plates 47 cause the number of larger lumps (i.e. above the specified size) to be reduced with the consequently more uniform end product obtained when crushing the materials rich in high-strength viscous fractions.

The overgrinding of the material due to a abrasion between the stationary projections 21 and the surface 48 of the plates 47 rotating together with the rotor 4 is then insignificant because of increased strength or viscosity of the material being crushed.

If non-crushable bodies get onto the disk 8 of the rotor 4, the peripheral portions 14 of the blades 9, together with the plates 47, similarly to the device of the basic embodiment, are deflected into the recesses 26 cut in the rotor disk 8. This is provided by having the distance B between the axis of the hinge 15 of each peripheral portion 14 of the fractionating blade 9 and the point on said plate 47 most removed therefrom such that it does not exceed shortest distance from the axis of said hinge 15 to the inner wall 22 of the casing 1.

What is claimed is:

1. A crushing device, comprising:

a causing having an inner wall;

a rotor having a vertical axis of rotation, mounted in said casing and formed by a disk having a working surface with radially oriented fractionating blades mounted thereon, each of said fractionating blades having a working lateral face and a lateral face opposite to said working lateral face and consisting of a main portion rigidly secured relative to said rotor disk and located closer to the axis of said rotor and a peripheral portion attached to said rotor disk by means of a hinge, mounted rotatably about the vertical axis, and having a section radially extending beyond said disk;

stationary grinding elements mounted on said inner wall of the casing coaxially with said rotor disk, formed by projections facing the rotor axis and located directly above said sections of the peripheral portions of the blades extending beyond said disk and spaced from said working surface of the rotor disk by a distance corresponding to a predetermined maximum size of pieces in a final crushed product;

said projections being spaced from said rotor disk by a radial clearance; and a drive for rotating the rotor.

2. A device as disclosed in claim 1, wherein provided in said rotor disk immediately behind each peripheral portion of the fractionating blade, at said lateral face of the blade opposite to its working lateral face, are recesses for receiving said peripheral portions of the fractionating blades, when they are deflected from the radial direction.

3. A device as disclosed in claim 2, wherein on said working surface of the rotor disk there are mounted radially oriented box projections rigidly secured relative to said rotor disk, each of said box projections having an upper wall, a first and a second side walls, said first side wall of the box projection being said working lateral face of the fractionating blade, said second side wall of the box projection being disposed behind said recess provided in the rotor disk.

4. A device as disclosed in claim 3, wherein:

in each peripheral portion of the fractionating blade there is provided a hole, and in said rotor disk there are provided holes in alignment with said holes provided in the peripheral portions of the fractionating blades, fingers with heads at the top are inserted into said holes, said hinges being formed by said fingers and said holes made in the peripheral portions and in the rotor disk; and in said upper wall of each box projection, opposite said heads of the fingers, there are provided openings for insertion and withdrawal of said fingers, each of said openings having a rim.

5. A device as disclosed in claim 4, wherein;

each said finger head is made asymmetric relative to the axis of rotation of said finger; and each opening provided in said upper wall of said box projection for withdrawal and insertion of said fingers is arranged on said upper wall such that the distance between the axis of said hinge and the rim of said opening on said upper wall, looking in the radial direction from the axis of said rotor, is less than the maximum distance from the axis of rotation of said finger to the rim of said finger head.

6. A device as disclosed in claims 1, 2, 3, 4 or 5, wherein:

a lining ring plate is mounted on the working surface of the rotor disk; and said main portions of the fractionating blades are provided on said lining plate.

7. A device as disclosed in claim 2, wherein:

said rotor is made symmetric about the horizontal plane;

each projection of said stationary grinding elements is symmetric about the plane coincident with the rotor axis; and the drive is made reversible.

8. A device as disclosed in claim 2, wherein:

mounted coaxially with said rotor on said inner wall of the casing is a screen grating located below said working surface of the rotor disk and radially spaced from said rotor; and said screen grating is provided with a shell with a duct for discharging non-crushable bodies.

9. A device as disclosed in claim 2, wherein, on each section of the peripheral portion of the fractionating blade extending beyond said disk, at said working lateral face of the fractionating blade, there is secured a plate lying in a horizontal plane and having an upper surface and an upper edge facing said rotor disk, said upper surface of the plate coinciding with said working surface of the rotor disk, said upper edge of the plate facing the rotor disk following an arc of the periphery of said rotor disk, the distance between the axis of said hinge securing said peripheral portion of the blade to the rotor disk and the point on said plate farthest removed therefrom not exceeding the shortest distance from the axis of said hinge to said inner wall of the device casing.

10. A device as disclosed in claim 9, wherein the center of gravity of said peripheral portion of the fractionating blade is displaced from the line passing through the axis of said hinge and the axis of rotation of said disk towards said lateral face of the fractionating blade opposite to its working lateral face.

* * * * *